US008894449B2

(12) United States Patent
Matsumoto et al.

(10) Patent No.: US 8,894,449 B2
(45) Date of Patent: Nov. 25, 2014

(54) TERMINAL BLOCK

(75) Inventors: Mitsuhiro Matsumoto, Makinohara (JP); Hajime Kato, Makinohara (JP); Tatsuya Goto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 27 days.

(21) Appl. No.: 13/498,401

(22) PCT Filed: Jul. 27, 2010

(86) PCT No.: PCT/JP2010/062989

§ 371 (c)(1),
(2), (4) Date: Mar. 27, 2012

(87) PCT Pub. No.: WO2011/043121

PCT Pub. Date: Apr. 14, 2011

(65) Prior Publication Data

US 2012/0184155 A1 Jul. 19, 2012

(30) Foreign Application Priority Data

Oct. 5, 2009 (JP) ..... 2009-231406

(51) Int. Cl.

| | |
|---|---|
| ***H01R 4/30*** | (2006.01) |
| ***H01R 9/24*** | (2006.01) |
| ***H01R 4/34*** | (2006.01) |
| *H01R 11/12* | (2006.01) |

(52) U.S. Cl.

CPC *H01R 9/24* (2013.01); *H01R 11/12* (2013.01); *H01R 4/34* (2013.01)

USPC ..... 439/727

(58) Field of Classification Search

USPC ..... 439/709, 722, 724, 727–729

See application file for complete search history.

(56) References Cited

U.S. PATENT DOCUMENTS 1,604,612 A * 10/1926 Starke ..... 439/491
2,872,506 A * 2/1959 Flubacker ..... 174/153 R (Continued)

FOREIGN PATENT DOCUMENTS

| | | | |
|---|---|---|---|
| JP | 61-28267 | U | 2/1986 |
| JP | 09-007664 | A | 1/1997 |
| JP | 2003-217706 | A | 7/2003 |
| JP | 2004-327185 | A | 11/2004 |

OTHER PUBLICATIONS

International Search Report mailed Sep. 7, 2010, issued for PCT/JP2010/062989.

(Continued)

*Primary Examiner* — Ross Gushi

(74) *Attorney, Agent, or Firm* — Edwards Wildman Palmer LLP; James E. Armstrong, IV; Carolina E. Save

(57) ABSTRACT

[Problem] To provide a compact terminal block.

[Means for solving problem]

A terminal block 1 includes: a terminal block main body 2 on which a plurality of seating surfaces 13 are provided; a plurality of fixing members 3 penetrating first and second connection terminals and fixing the first and second connection terminals to the seating surfaces 13 in a manner that the first connection terminals are connected to electronic devices, and the second connection terminals 8 to be electrically connected to the first connection terminals are overlapped with the seating surfaces 13. The seating surfaces 13 are sloped relative to a direction W that the first and second connection terminals are arranged.

4 Claims, 4 Drawing Sheets

(56) References Cited

U.S. PATENT DOCUMENTS

| | | | | |
|---|---|---|---|---|
| 4,174,147 | A * | 11/1979 | Waddington et al. | 439/636 |
| 4,345,806 | A * | 8/1982 | McHenney | 439/510 |
| 4,832,628 | A * | 5/1989 | Huska | 439/716 |
| 5,203,724 | A * | 4/1993 | Casey | 439/792 |
| 6,176,710 | B1 * | 1/2001 | Ewing et al. | 439/76.1 |
| 6,464,538 | B2 * | 10/2002 | Miyazaki et al. | 439/607.44 |
| 6,583,352 | B2 * | 6/2003 | Fukushima et al. | 174/373 |
| 6,595,789 | B2 * | 7/2003 | Oota et al. | 439/98 |
| 6,612,878 | B2 * | 9/2003 | Lias et al. | 439/709 |
| 6,655,989 | B1 * | 12/2003 | Gale et al. | 439/559 |
| 6,702,612 | B2 * | 3/2004 | Miyazaki et al. | 439/559 |
| 6,716,071 | B2 * | 4/2004 | Miyazaki | 439/859 |
| 6,814,617 | B2 * | 11/2004 | Oota et al. | 439/589 |
| 6,837,728 | B2 * | 1/2005 | Miyazaki et al. | 439/271 |
| 6,905,375 | B2 * | 6/2005 | Ikeda | 439/801 |
| 6,916,213 | B2 * | 7/2005 | Nyblin et al. | 439/709 |
| 7,041,907 | B2 * | 5/2006 | Miyazaki | 174/72 A |
| 7,059,918 | B2 * | 6/2006 | Matsumoto et al. | 439/752 |
| 7,077,676 | B2 * | 7/2006 | Matsumoto et al. | 439/271 |
| 7,094,098 | B2 * | 8/2006 | Miyazaki | 439/559 |
| 7,097,498 | B2 * | 8/2006 | Miyazaki | 439/559 |
| 7,264,506 | B2 * | 9/2007 | Mori et al. | 439/606 |
| 7,393,218 | B1 * | 7/2008 | Pavlovic et al. | 439/97 |
| 7,572,150 | B2 * | 8/2009 | Matsuoka | 439/626 |
| 7,597,580 | B1 * | 10/2009 | Advey et al. | 439/383 |
| 7,614,910 | B2 * | 11/2009 | Croteau et al. | 439/573 |
| 7,618,286 | B2 * | 11/2009 | Aoki et al. | 439/587 |
| 7,637,761 | B1 * | 12/2009 | Arnold | 439/212 |
| 7,722,372 | B2 * | 5/2010 | Matsumoto et al. | 439/213 |
| 7,811,116 | B2 * | 10/2010 | Sakakura et al. | 439/364 |
| 7,828,591 | B2 * | 11/2010 | Matsuoka | 439/559 |
| 7,934,950 | B2 * | 5/2011 | Yong | 439/559 |
| 7,950,969 | B1 * | 5/2011 | Savant | 439/722 |
| 7,955,141 | B2 * | 6/2011 | Jang et al. | 439/709 |
| 7,988,475 | B2 * | 8/2011 | Sakakura | 439/271 |
| 8,142,234 | B2 * | 3/2012 | Kaneshiro | 439/709 |
| 8,152,574 | B2 * | 4/2012 | Matsuoka et al. | 439/801 |
| 8,337,257 | B2 * | 12/2012 | Kaneshiro | 439/709 |
| 8,342,880 | B2 * | 1/2013 | Kato et al. | 439/595 |
| 8,393,911 | B2 * | 3/2013 | Aoki et al. | 439/272 |
| 8,422,222 | B2 * | 4/2013 | Noda | 361/689 |
| 8,446,058 | B2 * | 5/2013 | Avula et al. | 310/71 |
| 8,460,039 | B2 * | 6/2013 | Akuta | 439/722 |
| 8,465,331 | B2 * | 6/2013 | Shimowake et al. | 439/709 |
| 2002/0048994 | A1 * | 4/2002 | Oota et al. | 439/607 |
| 2002/0132522 | A1 * | 9/2002 | Miyazaki et al. | 439/559 |
| 2004/0072474 | A1 * | 4/2004 | Nyblin et al. | 439/709 |
| 2004/0144557 | A1 * | 7/2004 | Miyazaki | 174/72 A |
| 2004/0214477 | A1 * | 10/2004 | Ikeda | 439/709 |
| 2004/0235364 | A1 * | 11/2004 | Matsumoto et al. | 439/752 |
| 2005/0112955 | A1 * | 5/2005 | Buckley et al. | 439/727 |
| 2006/0063412 | A1 * | 3/2006 | Matsumoto et al. | 439/274 |
| 2007/0105427 | A1 * | 5/2007 | Mori et al. | 439/364 |
| 2009/0023345 | A1 * | 1/2009 | Matsumoto et al. | 439/720 |
| 2009/0029594 | A1 * | 1/2009 | Matsuoka | 439/626 |
| 2010/0009566 | A1 * | 1/2010 | Sakakura et al. | 439/364 |
| 2010/0159743 | A1 * | 6/2010 | Kato et al. | 439/587 |
| 2010/0261363 | A1 * | 10/2010 | Sakakura | 439/271 |
| 2011/0014822 | A1 * | 1/2011 | Kato et al. | 439/733.1 |
| 2011/0117784 | A1 * | 5/2011 | Matsuoka et al. | 439/626 |
| 2011/0117792 | A1 * | 5/2011 | Kaneshiro | 439/709 |
| 2011/0130049 | A1 * | 6/2011 | Kaneshiro | 439/709 |
| 2012/0021632 | A1 * | 1/2012 | Matsumoto et al. | 439/271 |
| 2012/0164867 | A1 * | 6/2012 | Matsumoto et al. | 439/345 |
| 2012/0178291 | A1 * | 7/2012 | Matsumoto et al. | 439/588 |
| 2012/0184155 | A1 * | 7/2012 | Matsumoto et al. | 439/709 |
| 2012/0186872 | A1 * | 7/2012 | Akuta | 174/70 B |
| 2012/0190232 | A1 * | 7/2012 | Akuta | 439/487 |
| 2012/0190251 | A1 * | 7/2012 | Akuta | 439/722 |
| 2012/0208404 | A1 * | 8/2012 | Matsumoto et al. | 439/661 |
| 2012/0223601 | A1 * | 9/2012 | Akuta | 310/58 |
| 2012/0225593 | A1 * | 9/2012 | Akuta | 439/722 |
| 2012/0238147 | A1 * | 9/2012 | Matsumoto et al. | 439/660 |
| 2012/0292101 | A1 * | 11/2012 | Kato | 174/72 A |
| 2013/0017719 | A1 * | 1/2013 | Tanaka et al. | 439/587 |
| 2013/0023158 | A1 * | 1/2013 | Kato et al. | 439/625 |
| 2013/0040473 | A1 * | 2/2013 | Tanaka et al. | 439/86 |
| 2013/0092412 | A1 * | 4/2013 | Tanaka et al. | 174/78 |
| 2013/0095704 | A1 * | 4/2013 | Awakura et al. | 439/709 |
| 2013/0130557 | A1 * | 5/2013 | Adachi et al. | 439/626 |

OTHER PUBLICATIONS

Written Opinion of the International Searching Authority mailed Sep. 7, 2010, issued for PCT/JP2010/062989.

Written Opinion of the International Preliminary Examining Authority mailed Apr. 19, 2011, issued for PCT/JP2010/062989.

International Preliminary Report of Patentability mailed Dec. 27, 2011, issued for PCT/JP2010/062989.

Japanese Office Action issued Aug. 27, 2013 in connection with Japanese Application No. 2009-231406.

Chinese Office Action issued Feb. 8, 2014 in connection with Chinese Application No. 201080043724.4. (English Translation).

* cited by examiner

TERMINAL BLOCK

TECHNICAL FIELD

This invention relates to a terminal block for electrically connecting terminal parts such as LA terminals connected to an electronic device to each other, and for fixing the terminal parts.

BACKGROUND ART

Various electronic devices are mounted on an electric vehicle, a hybrid vehicle, and a fuel-cell vehicle as a vehicle. Further, the electric vehicle, the hybrid vehicle, and the fuel-cell vehicle include: a motor as an electronic device for generating a driving power; a battery for supplying an electric power to the motor; and an inverter for converting DC power into AC power when the electric power of the battery is supplied to the motor. The motor, the battery, and the inverter are connected to each other with electric wires and terminal parts such as LA terminals attached to ends of the electric wires. A plurality of electric wires connected to the motor, the battery, and the inverter is fixed to a terminal block in a manner that the LA terminals connected to ends of the electric wires are overlapped with each other, and electrically connected to each other (for example, see Patent Document 1).

FIG. 5 is a perspective view showing a conventional terminal block is closed in the Patent Document 1. A terminal block 101 shown in FIG. 5 is made of synthetic resin, and formed in a box shape made by well-known injection molding. Further, a plurality of seating surfaces 113 are arranged on an upper wall of the terminal block 101 in a longitudinal direction (namely, arrow W direction) of the terminal block 101. Namely, the seating surfaces 113 are arranged along a direction that the LA terminals (not shown) overlapped with the seating surfaces 113 are arranged (namely, arrow W direction). Further, a nut 104 is buried under the center of each seating surface 113. When a bolt (not shown) inserting into the LA terminals is screwed into the nut 104 in a manner that two LA terminals as the terminal parts connected to the electronic device and the seating surface 113 are overlapped with each other, the LA terminals are fixed to the terminal block 101, and the LA terminals overlapped with each other are electrically connected to each other.

PRIOR ART DOCUMENT

Patent Document

Patent Document 1: JP. A, 2004-327185

DISCLOSURE OF THE INVENTION

Problem to be Solved by the Invention

However, in the conventional terminal block 101, there is a problem described below. Namely, in the conventional terminal block 101, a plurality of seating surfaces 113 are arranged in the longitudinal direction of the terminal block 101 (namely, arrow W direction). Namely, a plurality of seating surfaces 113 is arranged along a direction that a plurality of LA terminals overlapped with the seating surfaces 113 is arranged (namely, arrow W direction). Therefore, because a length in the direction arranging the LA terminals (namely, arrow W direction) becomes long, there is a problem that the conventional terminal block 101 cannot be mounted on a vehicle due to a space requirement of the vehicle.

Accordingly, an object of the present invention is to provide a compact terminal block.

Means for Solving the Problem

For attaining the object, according to the invention described in claim 1, there is provided a terminal block comprising:

a terminal block main body on which a plurality of seating surfaces is provided; and a plurality of fixing members for penetrating first and second connection terminals and fixing the first and second connection terminals to the seating surfaces in a manner that the first connection terminals connected to electronic devices, and the second connection terminals electrically connected to the first connection terminals are overlapped with the seating surfaces, wherein the seating surfaces are sloped relative to a direction that the first and second connection terminals are arranged, and wherein when a connector having a plurality of terminal fittings is attached to a case receiving the terminal block through an opening, the terminal fittings are arranged along the opening.

According to the invention described in claim 2, there is provided the terminal block as claimed in claim 1, wherein the seating surfaces are parallel to each other.

According to the invention described in claim 3, there is provided the terminal block as claimed in claim 1 or 2, wherein edges of the seating surfaces adjacent to each other in the direction that the first and second connection terminals are arranged are arranged along the direction that the first and second connection terminals are arranged.

Effects of the Invention

According to the invention claimed in claim 1, the seating surfaces provided on the terminal block are sloped relative to a direction that the first and second connection terminals are arranged. Therefore, comparing with a case that the seating surfaces are arranged along the direction that the first and second connection terminals are arranged, a compact terminal block in the direction that the first and second connection terminals are arranged can be provided.

According to the invention claimed in claim 2, the seating surfaces are parallel to each other. Therefore, a terminal block which is prevented from being defiled can be provided.

According to the invention claimed in claim 3, edges of the seating surfaces adjacent to each other in the direction that the first and second connection terminals are arranged are arranged along the direction that the first and second connection terminals are arranged. Therefore, a length of the terminal block in a direction perpendicular to the direction that the first and second connection terminals are arranged keeps constant, thereby, a compact terminal block in a direction perpendicular to the direction that the first and second connection terminals are arranged can be provided.

DESCRIPTION OF EMBODIMENTS

Figure 1:
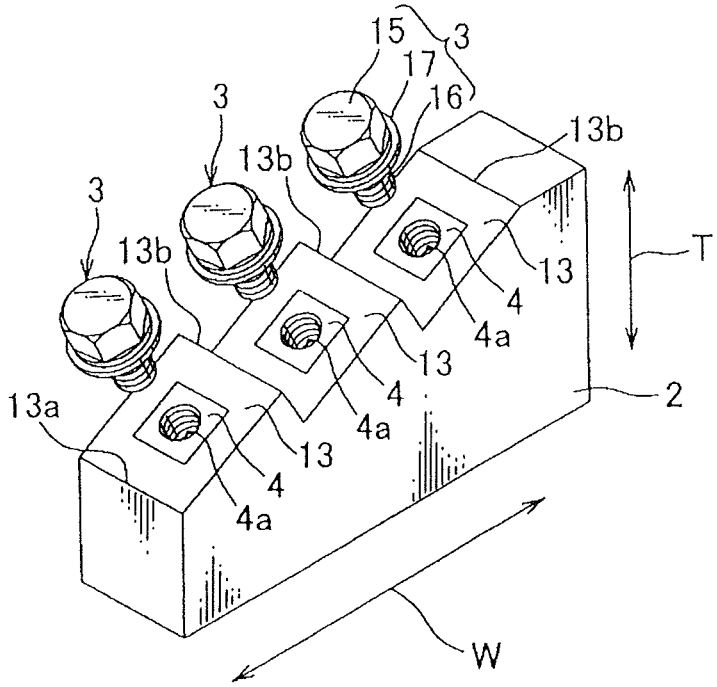
FIG. 1 A perspective view showing a terminal block according to an embodiment of the present invention.

Hereinafter, a terminal block according to an embodiment of the present invention will be explained with reference to FIGS. 1 to 4. A terminal block 1 shown in FIG. 1 includes: a terminal block main body 2 on which a plurality of seating surfaces 13 are provided; a plurality of bolts 3 as fixing members attached to the seating surfaces 13; and nuts 4. Further, in the terminal block 1, a shaft 16 of the bolt 3 is inserted into each of a plurality of first connection terminals 18 provided at ends of bus bars (not shown) connected to a motor, an inverter, and the like as electronic devices and second connection terminals 8 overlapped with the first connection terminals 18. The bolt 3 having the shaft 16 inserted into the first and second connection terminals fixes the first and second connection terminals to the terminal block main body 2, and electrically connects the first and second connection terminals to each other in a manner that the first and second connection terminals are overlapped with each other. Further, the terminal block 1 is received in a later-described case 9, and attached to a chassis of the electronic device. An arrow W in FIGS. 1 and 2 indicates a direction that the first and second connection terminals are arranged, and a longitudinal direction of the terminal block main body 2. An arrow T indicates a direction perpendicular to the direction that the first and second connection terminals are arranged, and a height direction of the terminal block main body 2.

Figure 2:
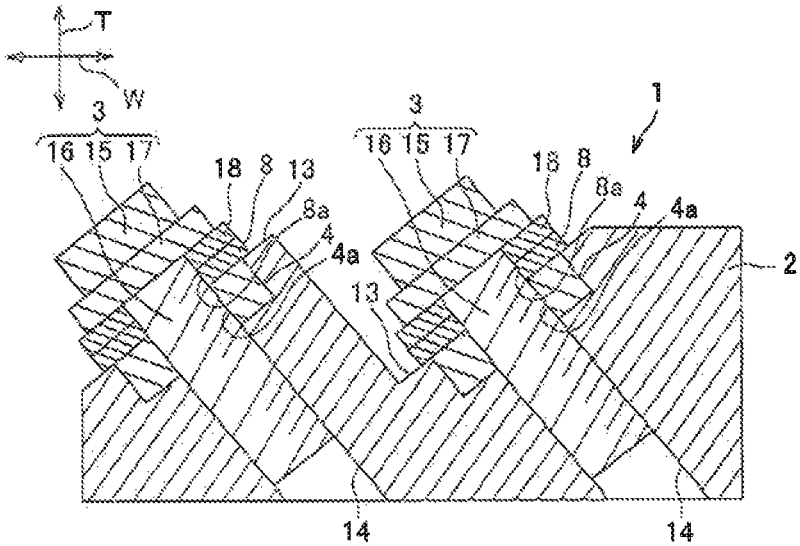
FIG. 2 A sectional view showing a state that a second connection terminal solely attached to the terminal block shown in FIG. 1.

The terminal block main body 2 is made of synthetic resin, and formed in a box shape made by well-known injection molding. A plurality of seating surfaces 13 is provided on the terminal block main body 2. The seating surface 13 faces a bottom wall (not shown) of the case 9, and formed flat. Further, as shown in FIGS. 1 and 2, a direction that the seating surfaces 13 are arranged is sloped relative to the direction that the first and second connection terminals are arranged, namely, the arrow W direction. The seating surfaces 13 are provided parallel to each other. Further, edges 13*a*, 13*b* of the seating surfaces 13 adjacent to each other in the direction that the first and second connection terminals are arranged, namely, the arrow W direction are arranged along the direction that the first and second connection terminals are arranged, namely, the arrow W direction. Further, as shown in FIGS. 1 and 2, an attaching hole 14 for screwing the bolt 3 is formed in the center of the seating surface 13. The nut 4 is buried into the attaching hole 14 and a through hole 4*a* of the nut 4 10 communicating to the attaching hole 14.

As shown in FIG. 1, the bolt 3 as the fixing member includes: the shaft 16 having a male thread on an outer periphery of a cylinder body; and a head 15 provided at an end of the shaft, and formed in a hexagonal shape in a plan view; and a washer 17 formed in a ring shape having a hole (not shown) for inserting the shaft 16, and configured to be overlapped with the head 15. Further, as shown in FIG. 2, the bolts 3 screwed into the nuts 4 and attached to the seating surfaces 13 are arranged parallel to each other.

As shown in FIGS. 1 and 2, an outer shape of the nut 4 is formed in a square shape, and an inner shape of the nut 4 is formed in a ring shape having a through hole 4*a* into which the shaft 16 of the bolt 3 is inserted, a female thread for screwing with the male thread formed on the shaft 16 of the bolt 3 is formed on an inner periphery of the through hole 4*a*. Further, a surface on which the through hole 4*a* of the nut 4 is formed is exposed from the seating surface 13, and the nut 4 is buried into the seating surface so that the surface of the nut 4 is in the same plane as the seating surface 13.

The bus bar is made by pressing a conductive metal plate. Further, the first connection terminal 18 is provided at one end of the bus bar. This first connection terminal 18 is formed in a ring shape having a through hole into which the shaft 16 of the bolt 3 is inserted, and configured to be overlapped with the seating surface 13. The other end of the bus bar is connected to the electronic device, while the first connection terminal 18 is provided on the one end of the bus bar.

Figure 4:
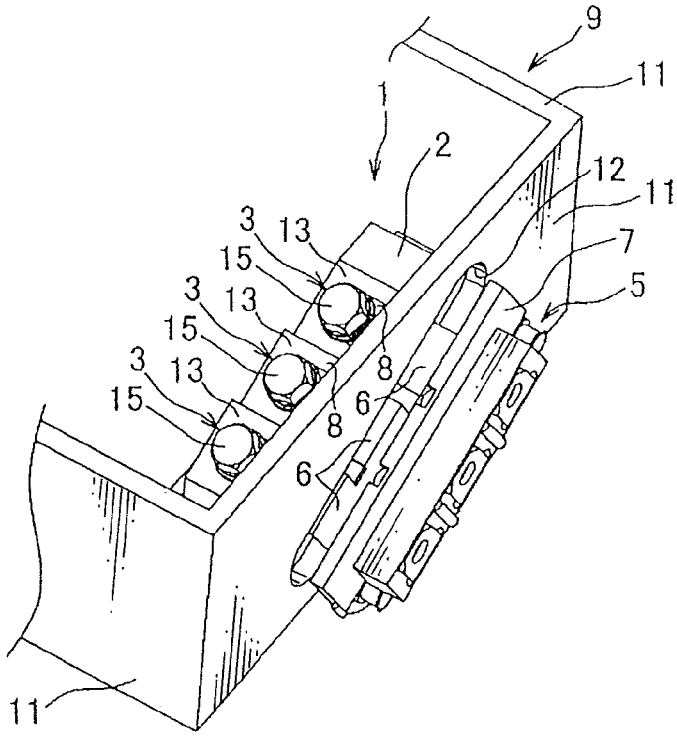
FIG. 4 A perspective view showing a state that the terminal block shown in FIG. 2 is received in the case.
Figure 5:
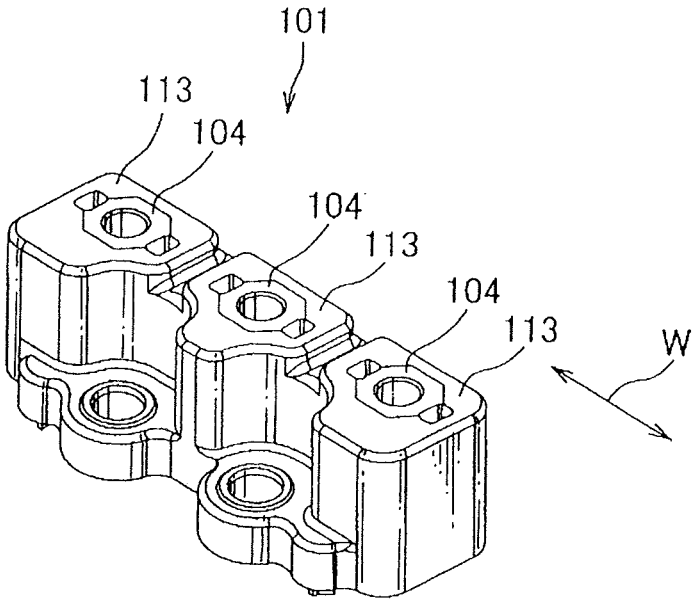
FIG. 5 PRIOR ART
FIG. 5 A perspective view showing a conventional terminal block.

As shown in FIG. 4, a connector 5 includes: a terminal fitting 6 made of conductive metal; an electric wire (not shown) connected to the terminal fitting 6; and a housing 7 made of synthetic resin and configured to cover a connection portion between the terminal fitting 6 and the electric wire (not shown). The second connection terminal 8 is provided at one end of the terminal fitting 6 (namely, the connector 5). This second connection terminal 8 is formed in a ring shape having a through hole 8*a* (shown in FIG. 2) into which the shaft 16 of the bolt 3 is inserted, and configured to be overlapped with the first connection terminal 18 and the sealing surface 13. The other end of the terminal fitting 6 is connected to an end of the electric wire, while the second connection terminal 8 is provided on the one end of the terminal fitting 6. Incidentally, "connection portion" means the other end of the terminal fitting 6 and the end of the electric wire connected to the other end of the terminal fitting 6.

Figure 3:
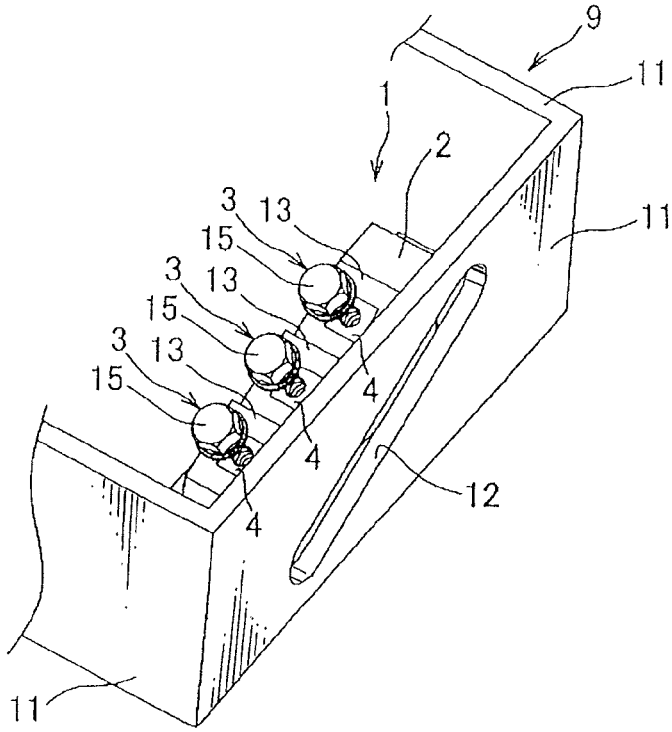
FIG. 3 A perspective view showing a state that the terminal block shown in FIG. 1 is received in a case.

As shown in FIG. 3, the case 9 is made of synthetic resin by well-known injection molding, and formed in a tubular shape having a bottom wall and a plurality of peripheral walls 11 extended vertically from edges of the bottom wall. Further, one surface of the bottom wall is overlapped with a chassis of the electronic device, and a terminal block 1 is mounted on the other surface of the bottom wall. A connector clearance 12 for supporting the connector 5 is formed on one of the peripheral walls 11. This connector clearance 12 penetrates the peripheral wall 11, and is formed in an oval shape in a plan view. Further, when the terminal block 1 is received in the case 9, the connector clearance 12 is positioned facing the seating surfaces 13. Namely, a direction of the connector clearance 12 is arranged is sloped relative to the direction that the first and second connection terminals are arranged, namely, the arrow W direction.

Next, an assembling, method of the terminal block 1 having the above-described structure will be explained. Firstly, the terminal block main body 2 is positioned in a manner that the connector clearance 12 formed on the case 9 faces the seating surfaces 13, and the connector clearance 12 is fixed to the bottom wall of the case 9. Then, the first connection terminal 18 provided at the one end of the bus bar connected to the electronic device, and the second connection terminal 8 provided at the one end of the connector 5, and inserted into the connector clearance 12 are overlapped with each other. Then, the shaft 16 of the bolt 3 is inserted into the through holes 8*a* of the first and second connection terminals. Then, the nut 4 is screwed with the bolt 3 having the shaft 16, thereby the first and second connection terminals are fixed to the terminal block main body 2. At the same time, the first and second connection terminals are electrically connected to each other, and the terminal block 1 is assembled.

According to the present invention described above, a plurality of seating surfaces 13 provided on the terminal block main body 2 are sloped relative to the direction that the first and second connection terminals are arranged 25 (namely, arrow W direction). Therefore, comparing with a case that the seating surfaces 13 are arranged along the direction that the first and second connection terminals are arranged (namely, arrow W direction), a compact terminal block 1 in the direction that the first and second connection terminals are arranged (namely, arrow W direction) can be provided.

Further, because the seating surfaces are parallel to each other, a terminal block 1 which is prevented from being defiled can be provided.

Further, the edges 13*a*, 13*b* of the seating surfaces 13 adjacent to each other in the direction that the first and second connection terminals are arranged are arranged along the direction that the first and second connection terminals are arranged (namely, arrow W direction). Therefore, a length of the terminal block in a direction namely, arrow T direction) perpendicular to the direction that the first and second connection terminals are arranged (namely, arrow W direction) keeps constant, thereby, a compact terminal block in a direction (namely, arrow T direction) perpendicular to the direction that the first and second connection terminals are arranged (namely, arrow W direction) can be provided.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

REFERENCE SIGNS LIST

1 terminal block
2 terminal block main body
3 bolt (fixing member)
8 second connection terminal
13 seating surface
arrow W a direction that the first and second connection terminals are arranged

The invention claimed is:

1. A terminal block comprising:

a terminal block main body on which a plurality of sloped seating surfaces integrally fixed to the terminal block main body are provided;

a plurality of fixing members for penetrating first and second connection terminals and fixing the first and second connection terminals to the sloped seating surfaces in a manner that the first connection terminals connected to electronic devices, and the second connection terminals electrically connected to the first connection terminals are directly overlapped with the sloped seating surfaces, wherein the sloped seating surfaces are sloped on an incline of the terminal block at different heights relative to a direction that the first and second connection terminals are arranged and a sloped angle of the sloped seating surfaces is fixed owing that the sloped seating surfaces are integrally fixed to the terminal block main body;

a connector having a plurality of terminal fittings attached extraneously to a case receiving the terminal block; and a sloped connector clearance formed on one of peripheral walls in the case through which the connector is attached, wherein the terminal fittings are arranged along the sloped connector clearance in the case, and wherein each fixing member includes a nut recessed into each sloped seating surface.

2. The terminal block as claimed in claim 1, wherein the sloped seating surfaces are parallel to each other.

3. The terminal block as claimed in claim 2, wherein edges of the sloped seating surfaces adjacent to each other in the direction that the first and second connection terminals are arranged are arranged along the direction that the first and second connection terminals are arranged.

4. The terminal block as claimed in claim 1, wherein edges of the sloped seating surfaces adjacent to each other in the direction that the first and second connection terminals are arranged are arranged along the direction that the first and second connection terminals are arranged.

* * * * *